US005274855A

United States Patent [19]

Franck, III

[11] Patent Number: 5,274,855

[45] Date of Patent: Jan. 4, 1994

[54] SIPHON FLUSHING MECHANISM AND METHOD

[75] Inventor: William F. Franck, III, Greensboro, N.C.

[73] Assignee: Windsor Products, Inc., Greensboro, N.C.

[21] Appl. No.: 978,738

[22] Filed: Nov. 19, 1992

[51] Int. Cl.[5] ..... E03D 1/06

[52] U.S. Cl. ..... 4/369; 4/376; 137/128; 137/143

[58] Field of Search ..... 4/368, 369, 370, 371, 4/372, 375, 376, 377; 137/128, 142, 143

[56] References Cited

U.S. PATENT DOCUMENTS

| | | | |
|---|---|---|---|
| 149,948 | 4/1874 | Murphy | 137/142 |
| 544,964 | 8/1895 | Curry | 137/128 |
| 679,069 | 7/1901 | Croppi et al. | 4/373 |
| 858,166 | 6/1907 | Eggleston | 137/143 X |
| 1,013,876 | 1/1912 | Hammond | 4/373 |
| 1,090,189 | 3/1914 | Balze | 4/373 |
| 1,216,797 | 2/1917 | Gove | 4/373 |
| 1,421,531 | 7/1922 | Moras | 4/369 |
| 1,604,759 | 10/1926 | Richards | 4/370 |
| 1,755,218 | 4/1930 | Jertberg | 137/128 |
| 2,120,856 | 6/1938 | Collison | 4/369 |
| 2,606,326 | 8/1952 | Niccolai | 4/369 |
| 2,612,903 | 10/1952 | Carnerero | 137/133 |
| 2,779,027 | 1/1957 | Jensen | 4/369 |
| 2,920,329 | 1/1960 | Niccolai | 4/369 |
| 2,957,182 | 10/1960 | Suarez | 4/369 |
| 3,358,295 | 12/1967 | Wolfgram | 4/372 |

FOREIGN PATENT DOCUMENTS

| | | | |
|---|---|---|---|
| 0013133 | of 1896 | United Kingdom | 4/370 |

*Primary Examiner*—Robert M. Fetsuga

[57] ABSTRACT

A siphon flush mechanism is provided for a conventional commode water storage tank in which a siphon metering valve is utilized to control the level of water contained within the flush mechanism. An arcuate flexible connector tube is lifted by the action of an external handle thereby providing fluid communication between two inverted U-shaped traps in the flush mechanism to actuate the flushing cycle.

9 Claims, 3 Drawing Sheets

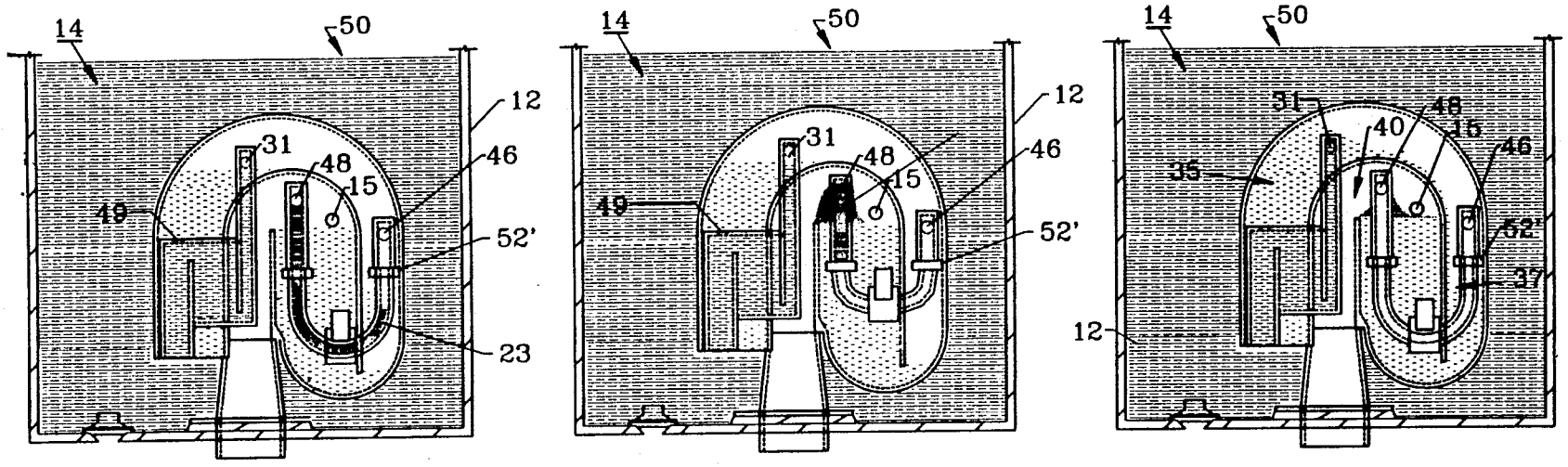
FIG. 6A
FIG. 6B
FIG. 6C
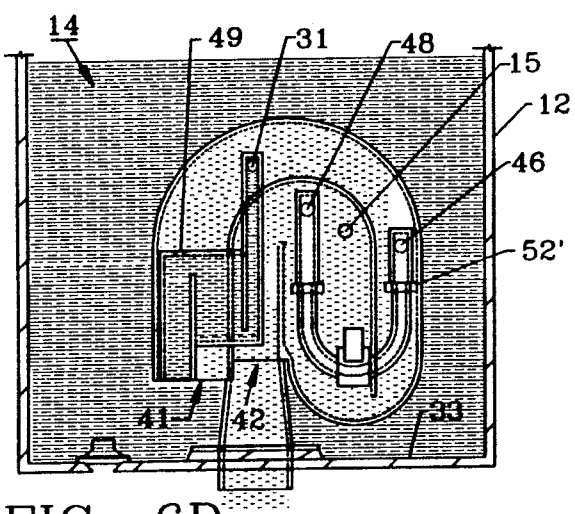
FIG. 6D
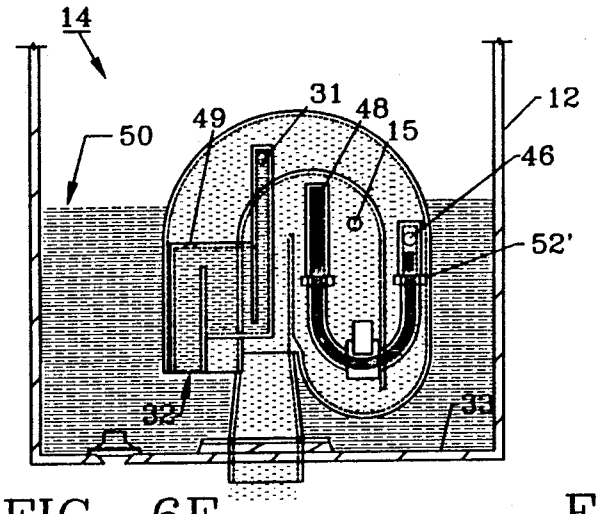
FIG. 6E
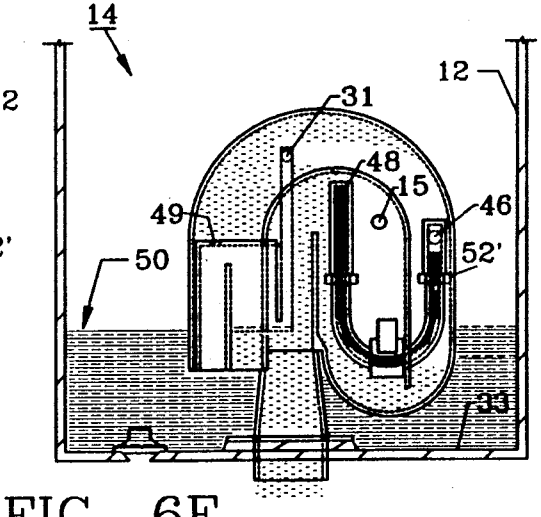
FIG. 6F

SIPHON FLUSHING MECHANISM AND METHOD

BACKGROUND OF THE INVENTION

1. Field Of The Invention

The invention herein pertains to a flush mechanism and particularly to a siphon flush mechanism for use in a conventional bathroom commode storage tank.

2. Description Of The Prior Art And Objectives Of The Invention

Various devices and mechanisms have been used in commodes in the past to allow water to properly discharge from the storage tank when the user flushes the bowl contents. A double siphon flushing device is provided in U.S. Pat. No. 2,612,903. U.S. Pat. No. 2,957,182 likewise demonstrates a siphon mechanism as does U.S. Pat. No. 2,120,856. A hand pump is used in U.S. Pat. No. 2,957,182 to direct air along an air line into one of the inverted U-shaped traps to activate the tank discharge cycle. U.S. Pat. No. 2,120,856 utilizes a mechanical valve within the tank while U.S. Pat. No. 2,612,903 is activated by an air piston arrangement. U.S. Pat. No. 2,779,027 illustrates a tube which if placed higher in the tank would cause flushing. Air pumps and pistons readily develop leaks and fail whereas mechanical devices which are in or slightly above the water in the storage tank will oftentimes corrode causing failure and must be frequently removed, cleaned and/or replaced.

The present invention has been conceived with the disadvantages and problems associated with prior art devices recognized and it is one objective of the present invention to provide a siphon flush mechanism which does not require an air pump or cylinder and which can be used for many years without failure, corrosion, repair or replacement.

It is yet another objective of the present invention to provide a conventional double siphon flush mechanism which includes a metering valve attached thereto to insure a proper fill of the liquid within the siphon mechanism and to extend the water level range in the storage tank.

It is still another objective of the present invention to provide a siphon flush mechanism which includes an arcuate flexible connector tube which can be raised to activate the flush cycle.

Various other objectives and advantages of the present invention will become apparent to those skilled in the art as a more detailed presentation is set forth below.

SUMMARY OF THE INVENTION

A siphon flushing mechanism for a commode is provided which is conventional in the art, but which includes a unique metering valve having three vertical chambers joined by an inverted and an upright U-shaped valve trap. The metering valve controls the amount of air which is entrapped within the siphon flush mechanism during the fill cycle and the metering valve is in fluid communication with an upper inverted U-shaped siphon trap. A flexible polymeric connector tube for containing liquid is disposed between upper inverted U-shaped siphon trap and a lower inverted U-shaped siphon trap. A conventional handle assembly mounted within the commode water storage tank allows the connector tube to be lifted, thereby emptying the liquid contents therefrom and ultimately providing fluid communication between the inverted siphon traps of the flush mechanism to activate the flush cycle. After the flush cycle is complete, the metering valve acts as a siphon break and allows the siphon mechanism to refill with water to the desired levels so another flush cycle can be initiated.

BRIEF DESCRIPTION OF THE DRAWINGS

FIGS. 6A–6F show the discharge cycle of the flush mechanism; and

DESCRIPTION OF THE PREFERRED EMBODIMENT

Figure 2:
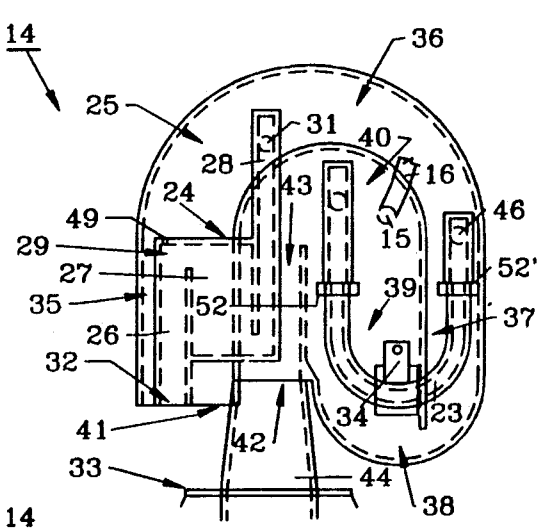
FIG. 2 illustrates an enlarged front elevational view of the flush mechanism with attached metering valve and connector tube.

The preferred form of the invention is shown in FIG. 2 in which a standard double siphon flush mechanism is shown and to which a metering valve has been attached along the front wall thereof. Also affixed to the front wall is an arcuate, flexible, transparent connector tube attached by pivot members at two points which are on a horizontal line. The height of the pivot points is critical to prevent incomplete flushing when the storage tank is not sufficiently filled. The connector tube provides fluid communication between stacked upper inverted U-shaped trap and lower inverted U-shaped trap of the siphon mechanism. The preferred method of the invention comprises lifting the lower curved portion of the arcuate connector tube thereby allowing the tube to bend at the pivot points and the liquid therein to be expelled into the lower inverted U-shaped trap to allow air to readily pass through said connector tube between lower inverted U-shaped trap and the upper inverted U-shaped trap even as the flexible, resilient connector tube returns to its original position. The air passage equalizes the pressure in the siphon mechanism causing the water contained therein to begin flowing from the water storage tank through the siphon mechanism and into the bowl below to flush the bowl.

DETAILED DESCRIPTION OF THE DRAWINGS AND OPERATION OF THE INVENTION

Figure 1:
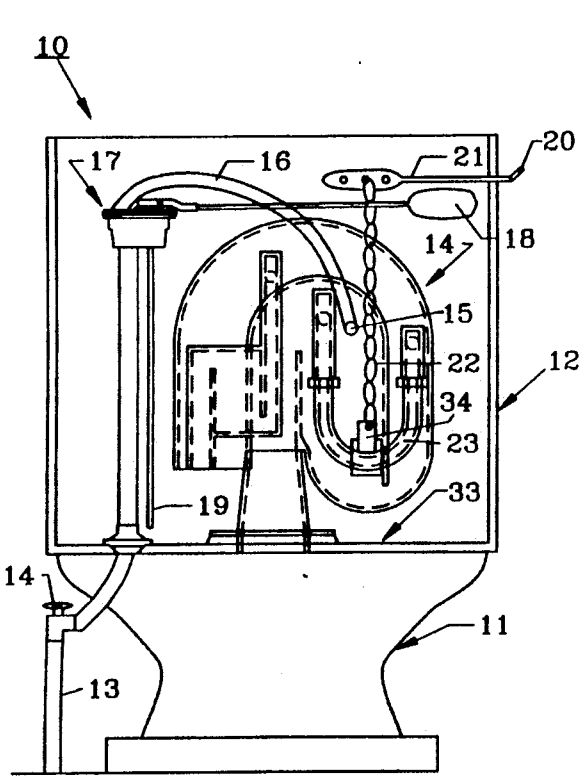
FIG. 1 shows a conventional bathroom commode in which the siphon flush mechanism of the invention has been positioned.

Turning now to the drawings, for a better understanding of the invention and its operation, FIG. 1 illustrates a conventional bathroom commode 10 having a bowl 11 and a water storage tank 12 postioned on the rear ledge portion of bowl 11. Water line 13 is connected to a conventional water source and valve 14 allows the user to cut off the supply water to tank 12 as needed. Tank 12 is cut-away to better illustrate the positioning of siphon flush mechanism 14 contained therein. Flush mechanism 14 includes a fill line opening 15 through which water is supplied by fill line 16 connected to float valve 17. Float valve 17 is a conventional valve and is regulated by float 18 which is supported by the water level within tank 12. As would be understood, float valve 17 regulates the flow of water to flush mechanism 14 through fill line 16 and to the interior of tank 12 through tank fill line 19 through water line 13. Tank 12 maintains flush handle 20 in a convenient external position and handle 20 is joined to connecting rod 21. Chain 22 is attached to rod 21 at its upper end and at the lower end of chain 22, flexible connector tube 23 is attached by chain connector 34. Flexible connector tube 23 may have a one-eighth to one-quarter inch inside diameter and may be formed from rubber, a flexible plastic or the like to withstand multiple bending as commode 10 is flushed. As conventional in the art, upon depressing handle 20, tank 12 is emptied through flush mechanism 14 into bowl 11 which by siphon action then discharges the liquid into a sewer or other waste treatment provision. Immediately upon discharge of bowl 11, water line 13 supplies fresh water through valve 17 to refill tank 12 through tank fill line 19 and to flush mechanism 14 through fill line 16. After the fill cycle has been completed the flush cycle can then be repeated.

Figure 4:
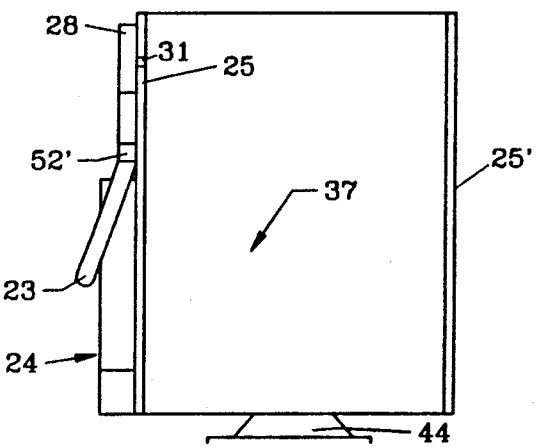
FIG. 4 pictures a right side elevational view of the device as shown in FIG. 2.
Figure 3:
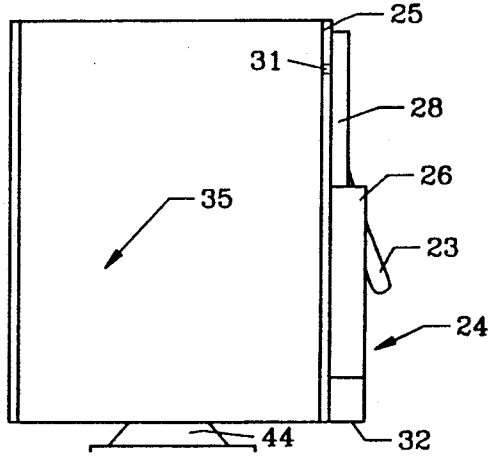
FIG. 3 demonstrates a left side elevational view of the device as shown in FIG. 2.

As additionally shown in FIGS. 3 and 4, siphon flush mechanism 14 includes front wall 25 and rear wall 25'. Metering valve 24 and connector tube 23 are attached to front wall 25. Connector tube 23 is resilient to withstand multiple bendings without failure and formed from a suitable polymeric material such as Neoprene or other durable flexible plastics. Connector tube 23 passes through and pivots or bends at pivot members 52, 52' (which are affixed to front wall 25) when raised by the action of handle 20 (FIG. 1). Front wall 25 and the entire construction of siphon flush mechanism 14 may be formed from a suitable, non-rusting material such as a durable acrylic plastic or the like. Likewise, metering valve 24 may likewise be formed from a similar material.

In FIG. 2, flush mechanism 14 is shown with metering valve 24 mounted on front wall 25. Metering valve 24 includes three upright chambers: forward valve chamber 26, middle valve chamber 27, and rearward valve chamber 28 which are joined to form a water path by an inverted U-shaped trap 29 and upright U-shaped trap 30 joined thereto. As further shown in FIG. 2, forward valve chamber 26 defines a liquid inlet port 32 at the lower or terminal end thereof and a pressure equalizing and priming aperture 49 while rearward valve chamber 28 defines a fluid aperture 31. Thus, water from supply tank 12 upon rising above tank floor 33 will enter liquid inlet port 32, will rise within forward valve chamber 26, spill over into middle valve chamber 27 through inverted valve trap 29, will then pass through upright U-shaped valve trap 30, will then rise in rearward valve chamber 28 and will stabilize with the water level within first chamber 35 of flush mechanism 14. As further seen in FIG. 2, first chamber 35 having a liquid entry port 41 is joined to upper inverted U-shaped trap 36 as is second chamber 37. Chamber 37 terminates at upright U-shaped trap 38 which also joins third chamber 39. Atop chamber 39 is lower inverted U-shaped trap 40 which is joined to fourth chamber 43 which defines discharge port 42 at the bottom end thereof. Traps 36 and 40 are commonly referred to as "stacked". Thus, water entering liquid entry port 41 moves first through chamber 35, through upper inverted U-shaped trap 36, through second chamber 37 past upright U-shaped trap 38 into third chamber 39 through lower inverted U-shaped trap 40 through fourth chamber 43 and out discharge port 42. Outlet extension 44 is joined to discharge port 42 and provides a conduit for liquid passage into bowl 11. As would be understood, water enters siphon flush mechanism 14 from surrounding tank 12 through liquid entry port 41 while simultaneously entering metering valve 24 through inlet port 32.

Figure 5A:
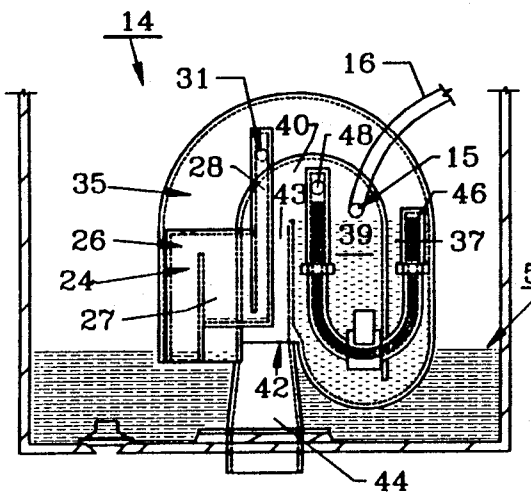
FIGS. 5A–5F depict the fill cycle of the flush mechanism.
Figure 5B:
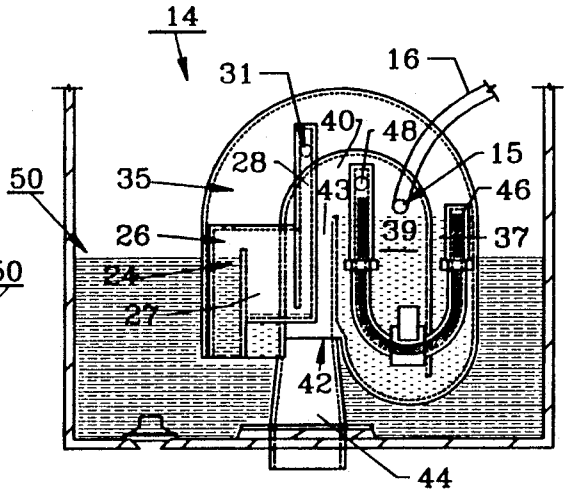
Figure 5C:
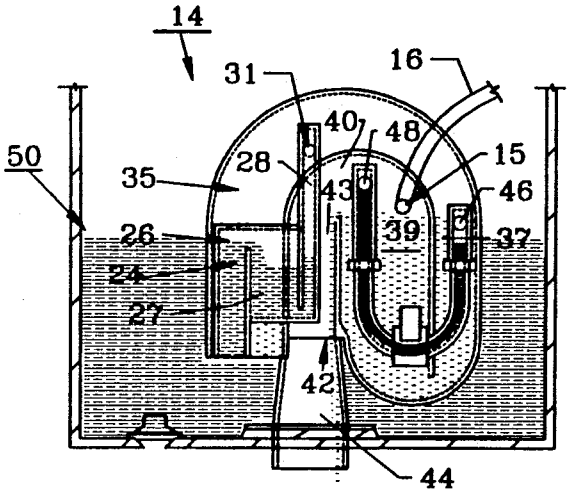

The fill cycle of siphon flush mechanism 14 is illustrated in FIGS. 5A through 5F. In FIG. 5A, water level line 50 is shown at approximately the height of discharge port 42 whereby float 18 (not shown in FIG. 5A) would be fully depressed. Flexible, transparent connector tube 23 is also filled with water which passes through opening 46 or in certain configurations, opening 48. Water also flows through fill line 16 through lower inverted trap 40 and into chambers 37 and 39. Water is contained within second chamber 37 and third chamber 39 and water slightly flows from fourth chamber 43 through discharge port 42. As water level line 50 rises as shown in FIG. 5B, metering valve forward chamber 26 has filled with water and water has risen in chamber 35 via liquid entry port 41. In FIG. 5C liquid from forward valve chamber 26 has spilled over into middle valve chamber 27 closing off air escape through apertures 31 and 49 as water level line 50 has risen slightly more than in FIG. 5B. Water also has begun trickling through fourth chamber 43 out discharge port 42 and through outlet extension 44 into bowl 11 (not shown) therebelow. Water has also risen in rearward valve chamber 28 of metering valve 24 and the water level in connector tube 23 is lowered below aperture 46 and overflows through aperture 48. Aperture 48 may be positioned below the top of third chamber 39 although it is seen in FIGS. 5A–5G as above the top of third chamber 39. The overflow into fourth chamber 43 is caused by the air pressure in upper inverted U-shaped trap 36 due to the rise of water in first chamber 35 shown (by broken line arrow) in FIG. 5C.

Figure 5D:
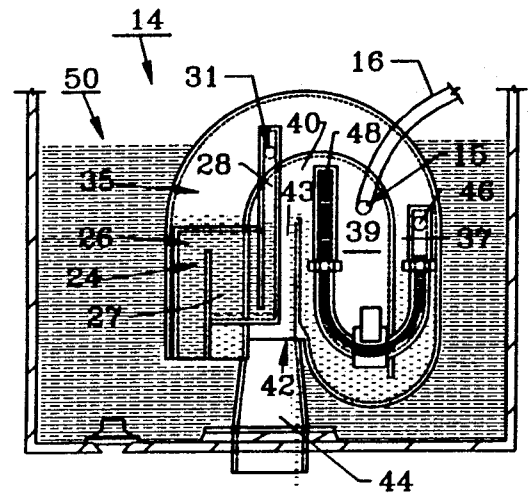
Figure 5E:
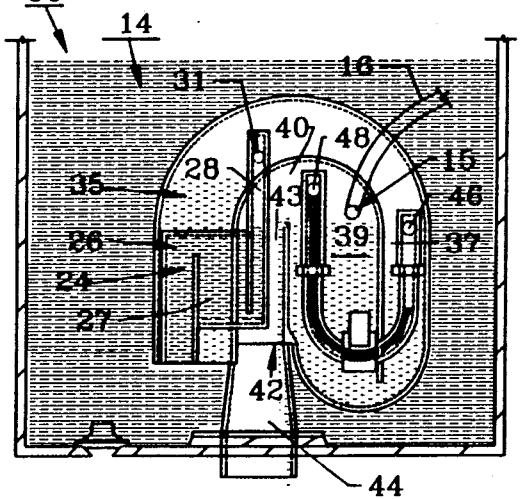

In FIG. 5D water level line 50 is seen above lower inverted U-shaped trap 40 and has continued to rise in rearward valve chamber 28. The water in connector tube 23 is lowered further from aperture 46 and continues to spill out of aperture 48. In FIG. 5E, water in first chamber 35 continues to rise into upper inverted U-shaped trap 36 while water continues to trickle through discharge port 42.

Figure 5F:
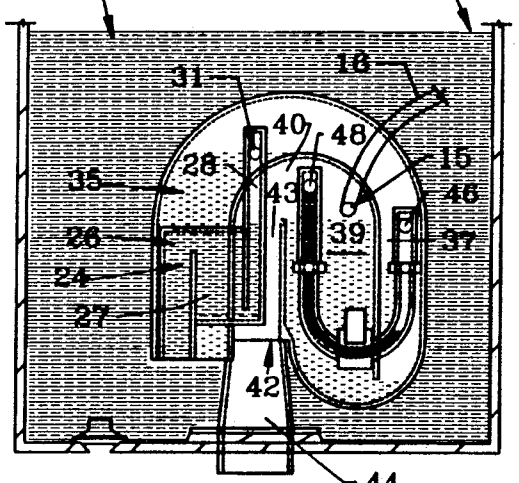

In FIG. 5F siphon flush mechanism 14 has stabilized with static water columns now positioned in metering valve 24, first chamber 35 and third chamber 39. A very short column is also shown in second chamber 37. Connector tube 23 has the water level below aperture 46 fully depressed. Pressures have equalized within upper inverted U-shaped trap 36 and second chamber 37 and no additional water overruns lower inverted U-shaped trap 40 and through discharge port 42. Also float 18 has closed float valve 17 and water has ceased passing along fill lines 16 and 19. With the flush mechanism in tank 12 so filled, the flush or discharge cycle can now begin as illustrated in FIGS. 6A–6F.

By rotating handle 20 as shown in FIG. 1 downwardly, rod 21 is raised thereby tightening flush chain 22, causing connector tube 23 to lift and pivot at points 52, 52' (FIG. 2) as shown in FIG. 6B allowing water within connector tube 23 to be expelled through drain port 48. In FIG. 6C, air then flows through connector tube 23 through drain port 48 and opening 46 allowing pressure in upper inverted U-shaped trap 36 and lower inverted U-shaped trap 40 to equalize, thereby allowing water to flow from first chamber 35 through upper inverted U-shaped trap 36 into second chamber 37. As water flows through upper inverted U-shaped trap 36, it then moves along the flow path from inlet 41 through discharge port 42 as shown in FIGS. 6D and 6E. Water continues to discharge through discharge port 42 until the water level reaches a position substantially as shown in FIG. 6F. As the water level line 50 reaches trap 30 (FIG. 2) in metering valve 24, the venturi effect at aperture 31 continues to discharge the remaining column of water in rearward chamber 28. The siphon at upper U-shaped trap 36 is then broken.

Figure 7:
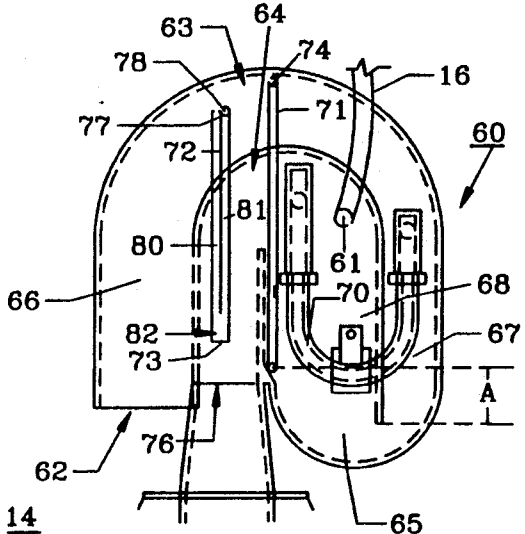
FIG. 7 shows another embodiment of the flush mechanism with a priming tube.

FIG. 7 shows another embodiment of the invention as flush mechanism 60 is illustrated in a frontal view without water therein. Flush mechanism 60 includes fill inlet 61, tank water inlet 62 and like first embodiment 14, has two inverted U-shaped traps: upper inverted U-shaped trap 63 and lower inverted U-shaped trap 64. Upright trap 65 connects second chamber 67 with third chamber 68. First chamber 66 defines tank water inlet 62 and fourth chamber 69 defines water discharging port 76. There is no metering valve shown on flush mechanism 60, but flexible connector tube 70 functions like connector tube 23 on flush mechanism 14 to initiate the flush cycle. Water conduit tube 71 allows fluid communication between upper inverted U-shaped trap 63 and third chamber 68 whereas priming tube 72 provides fluid communication between upper inverted U-shaped trap 63 (or chamber 66) and water storage tank 12 (not shown in FIG. 7) via opening 73. Priming tube 72 acts as a siphon break and also allows a soda straw or other tube to be inserted vertically into first upper opening 77 to allow air to be blown in, which passes into second upper opening 78 for initial priming of flush mechanism 60, for example, if after first installing with fill inlet 61 closed (prior to connection with fill line 16). As seen priming tube 72 comprises two parallel chambers 80, 81 which define opening 73 at their lower ends. Opening 78 allows fluid communication with upper inverted U-shaped trap 63. Conduit tube 71 terminates a distance "A" as seen in FIG. 7 approximately one-quarter of an inch above the bottom of second chamber 67. This distance maintains the slight, proper water level in second chamber 67 by discharging excess air pressure prior to flushing.

During the flush cycle of flush mechanism 60, as the water in storage tank 12 falls near opening 73 in conduit tube 72, air rushes into opening 77, through chambers 80, 81 through second upper opening 78 and on into upper trap 63, breaking the siphon and the flushing action taking place. Opening 73 is positioned a slight distance, such as one-half an inch above tank water inlet 62 to allow a smoother, less noisy and violent siphon break than if water inlet 62 were solely used to break the siphon action.

Also conduit tube 71 provides a means for pressure relief having a relatively small diameter, for example one-eighth of an inch. The small size prevents excess noise and turbulence and as heretofore mentioned regulates the level of the slight water column in second chamber 67 upon filling. Upper opening 74 in water conduit 71 could be positioned at a variety of locations along upper U-shaped trap 63 and second chamber 67, while the lower opening 75 has a vertically critical position slight above upright trap 65. Conduit 71 could also consist of a multiple number of small diameter tubes to lessen any noise or turbulence during the fill cycle of flush mechanism 60.

Flush mechanism 14 as seen in FIG. 2 and flush mechanism 60 as seen in FIG. 7 demonstrate large volume first and third chambers 35, 66 and 39, 68 respectively. It has been found that a large volume chamber having approximately twice the volume of the succeeding chamber allows a more efficient water flow. For example, in FIG. 2 water must make a relatively sharp turn when passing through lower inverted U-shaped trap 40 into fourth chamber 43. Large third chamber 39 provides an overfeed situation for fourth chamber 43 causing the water to more readily flow into fourth chamber 43, even at times when the storage tank level may be relatively low. As seen first chamber 35 is approximately twice the width of second chamber 37 and third chamber 39 is approximately twice the width of fourth chamber 43 and has a volume of twice that of fourth chamber 43. Flush mechanism 60 is also sized with first chamber 66 and third chamber 68 approximately twice the volume of second chamber 67 and fourth chamber 69 as seen in FIG. 7.

The fill and flush cycles described herein allow the user efficiency and years of maintenance free operation without concern of sticking or worn flapper valves now in widespread usage in standard commode storage tanks.

The illustrations and examples provided herein are for explanatory purposes and are not intended to limit the scope of the appended claims.

I claim:

1. In a siphon flushing mechanism for positioning within a liquid tank, said mechanism having four chambers connected by two stacked inverted U-shaped traps connected by one upright U-shaped trap with the upper inverted U-shaped trap joined to a chamber defining a liquid entry port and the lower inverted U-shaped trap joined to a chamber defining a discharge port, the improvement comprising:

a flexible connector tube mounted to said siphon flushing mechanism to provide fluid communication between said lower inverted U-shaped trap and said upper inverted U-shaped trap, a handle, said flexible connector shaped to create a liquid seal between said lower and upper inverted U-shaped traps, said handle adapted to be movably attached to said tank and attached to said flexible connector to move said connector tube to initiate flushing, whereupon flushing, liquid within said connector tube is discharged into said lower inverted U-shaped trap allowing air to pass between said lower inverted U-shaped trap and said upper inverted U-shaped trap causing liquid to flow by siphon action from said tank into said entry port, through said inverted and upright U-shaped traps and out said discharge port to discharge the liquid from the tank.

2. A flushing mechanism as claimed in claim 1 and including a fill line, said fill line connected to said lower inverted U-shaped trap.

3. A flushing mechanism as claimed in claim 2 wherein said fill line is connected to a water line.

4. A flushing mechanism as claimed in claim 1 and including a metering valve, said metering valve joined to said siphon flushing mechanism, said valve comprising a trio of valve chambers, an inverted U-shaped valve trap, said inverted U-shaped valve trap defining a relief port, an upright U-shaped valve trap, said valve traps connecting said trio of valve chambers, one of said valve chambers joined to said inverted U-shaped valve trap and defining a liquid inlet, another one of said valve chambers joined to said upright U-shaped valve trap and defining a fluid aperture, said fluid aperture communicating with said upper inverted U-shaped trap.

5. A flushing mechanism as claimed in claim 4 wherein said metering valve comprises a middle valve chamber joined to said inverted U-shaped valve trap and joined to upright valve trap.

6. A flushing mechanism as claimed in claim 4 wherein said metering valve is positioned adjacent said chamber defining said liquid entry port.

7. A method for flushing a liquid filled storage tank having a siphon mechanism therein, the siphon mechanism having four chambers connected by two stacked inverted U-shaped traps connected by one upright U-shaped trap to form a flow path having a liquid entry port at one end of said flow path and a discharge port at the other end of said flow path, said siphon mechanism having a flexible connector tube mounted to sad siphon flushing mechanism to provide fluid communication between said stacked inverted U-shaped traps, said connector tube shaped to create a liquid seal between said lower and upper inverted U-shaped traps, the method comprising the steps of:

(a) movably mounting a handle to the storage tank and connecting said handle to said connector tube;

(b) filling said connector tube with liquid;

(c) forming a first column of liquid above said liquid entry port and a second column of liquid between said upright U-shaped trap and said lower inverted U-shaped trap; and (d) removing said liquid from said connector tube by moving said handle to move, said connector tube; thereby allowing air to pass through said connector tube between said stacked inverted U-shaped traps causing said first column of liquids to flow along the path through the upper of said stacked inverted U-shaped traps, through said upright U-shaped trap where said first column of liquid mixes with said second column of liquid and said mixture contains through said lower inverted U-shaped trap and out said discharge port while liquid from said storage tank enters through said entry port and moves along said flow path to said discharge port to thereby flush said tank.

8. The method of claim 7 and including the step of refilling the tank with liquid.

9. The method of claim 7 wherein the step of refilling the tank includes the step of providing a first and a second column of static liquid in said siphon mechanism.

* * * * *